United States Patent [19]

Brown

[11] Patent Number: 4,504,191

[45] Date of Patent: Mar. 12, 1985

[54] HEATED CEILING FAN

[76] Inventor: David J. Brown, 104 Ashley Brook Ct., Mauldin, S.C. 29662

[21] Appl. No.: 437,540

[22] Filed: Oct. 29, 1982

[51] Int. Cl.[3] ..... F04D 29/38

[52] U.S. Cl. ..... 416/5; 416/95; 416/146 R; 416/241 R; 219/372

[58] Field of Search ..... 416/5, 146 R, 95, 241 R; 219/372

[56] References Cited

U.S. PATENT DOCUMENTS

| | | | |
|---|---|---|---|
| 449,404 | 3/1891 | Dewey | 416/95 X |
| 684,459 | 10/1901 | Porter | 416/95 X |
| 1,479,494 | 1/1924 | Beck | 416/95 X |
| 1,737,912 | 12/1929 | Bogard | 219/372 |
| 1,807,359 | 5/1931 | Waters | 416/95 |
| 2,110,621 | 3/1938 | Cohen | 416/95 X |
| 2,119,398 | 5/1938 | Morse | 416/5 |
| 2,619,578 | 11/1952 | Jepson et al. | 416/5 X |
| 2,695,146 | 11/1954 | DeWitt | 416/95 X |
| 3,020,386 | 2/1962 | Naxon | 416/95 X |
| 3,492,148 | 1/1970 | Hervert | 416/95 X |
| 3,997,758 | 12/1976 | Patel | 219/372 X |
| 4,064,427 | 12/1977 | Hansen et al. | 416/5 X |
| 4,382,400 | 5/1983 | Stutzman | 416/5 X |

FOREIGN PATENT DOCUMENTS

| | | | |
|---|---|---|---|
| 464906 | 8/1951 | Italy | 219/372 |
| 1208928 | 10/1970 | United Kingdom | 416/95 |

*Primary Examiner*—Everette A. Powell, Jr.
*Attorney, Agent, or Firm*—Bailey & Hardaway

[57] ABSTRACT

A heated ceiling fan comprising a plurality of blades with heating means in each of the blades.

2 Claims, 4 Drawing Figures

HEATED CEILING FAN

BACKGROUND OF THE INVENTION

This invention relates generally to the art of fans for air-movement and more particularly to a fan utilizable for both heating and cooling purposes.

During the first half of the twentieth century overhead cooling fans were utilized in tropical environments for the purpose of maintaining airflow within a room so as to make such environments more habitable. The ability of such overhead ceiling fans to produce a comfortable atmosphere was quite effective. With the advent, however, of widespread use of air-conditioning during the mid-twentieth century, the use of such overhead ceiling fans diminished and for all practical purposes disappeared. Greatly increased energy prices during the 1970's brought about recognition of the cooling power of such overhead ceiling fans. The use of such fans became not only energy conserving efficient but fashionable.

While such overhead ceiling fans have become better ornamented throughout time, few additions or improvements have been made in the overall functionality of the device. One such improvement was the addition of an incondescent light to the central portion of the fan so that the ceiling area consumed by such fan provided not only air movement, but light. Such overhead ceiling fans have also been improved by the addition thereto of rheostats so as to control the speed of the fan and also rheostats for controlling the brightness of any light fixtures associated therewith.

SUMMARY OF THE INVENTION

It is thus an object of this invention to improve upon a conventional overhead ceiling fan.

It is a further object of this invention to provide an overhead ceiling fan which is not only capable of providing air-movement but also is capable of providing heat.

It is a still further and more particular object of this invention to provide a novel overhead ceiling fan which is capable of providing heat to a room in both radiant and both convective modes.

These as well as other objects are accomplished by a ceiling fan having a plurality of blades, means for rotating the blades about a vertical axis and heating means associated with each of the plurality of blades for the purpose of radiatively and convectively heating the volume of air adjacent the blades.

DETAILED DESCRIPTION

In accordance with this invention it has been found that significant added utility in an overhead ceiling fan may be brought about by the addition thereto of means for heating. The improved ceiling fan in accordance with this invention has been found capable of fulfilling not only the entire heating requirements for dwellings in tropical climates, but also capable of quick recovery supplemental heat in non-tropical climates. Various advantages and aspects of this invention will become more apparent from a reading of the following detailed description given with reference to the various features of drawing.

Figure 1:
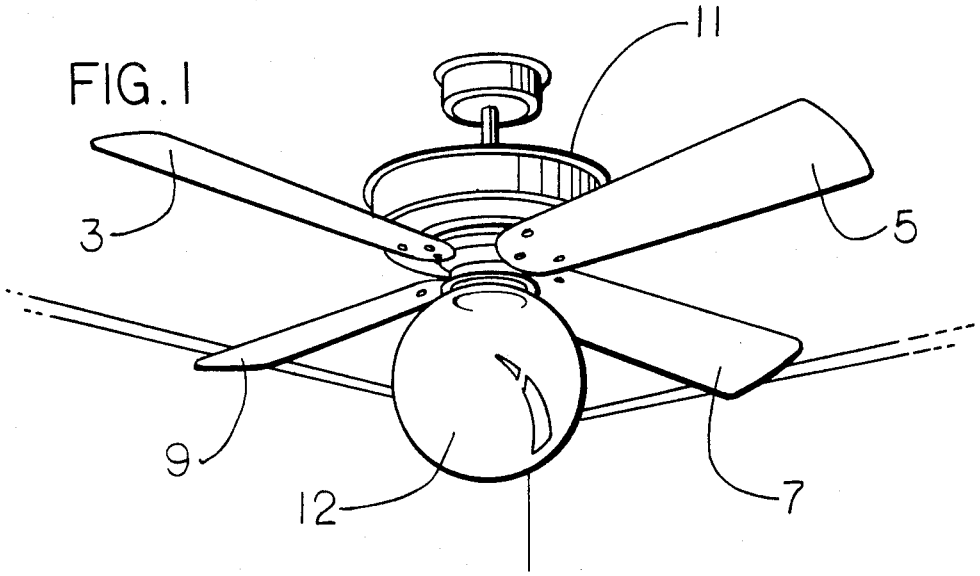
FIG. 1 of the drawings illustrates a ceiling fan in accordance with this invention.

FIG. 1 of the drawings illustrates an isometric view of ceiling fan in accordance with this invention. For all practical purposes FIG. 1 of the drawings is indistinguishable from a conventional ceiling fan. The ceiling fan of FIG. 1 comprises a plurality of blades 3, 5, 7, and 9 extending from a motor housing 11. Additionally, illustrated in FIG. 1 is a light fixture 12.

Figure 2:
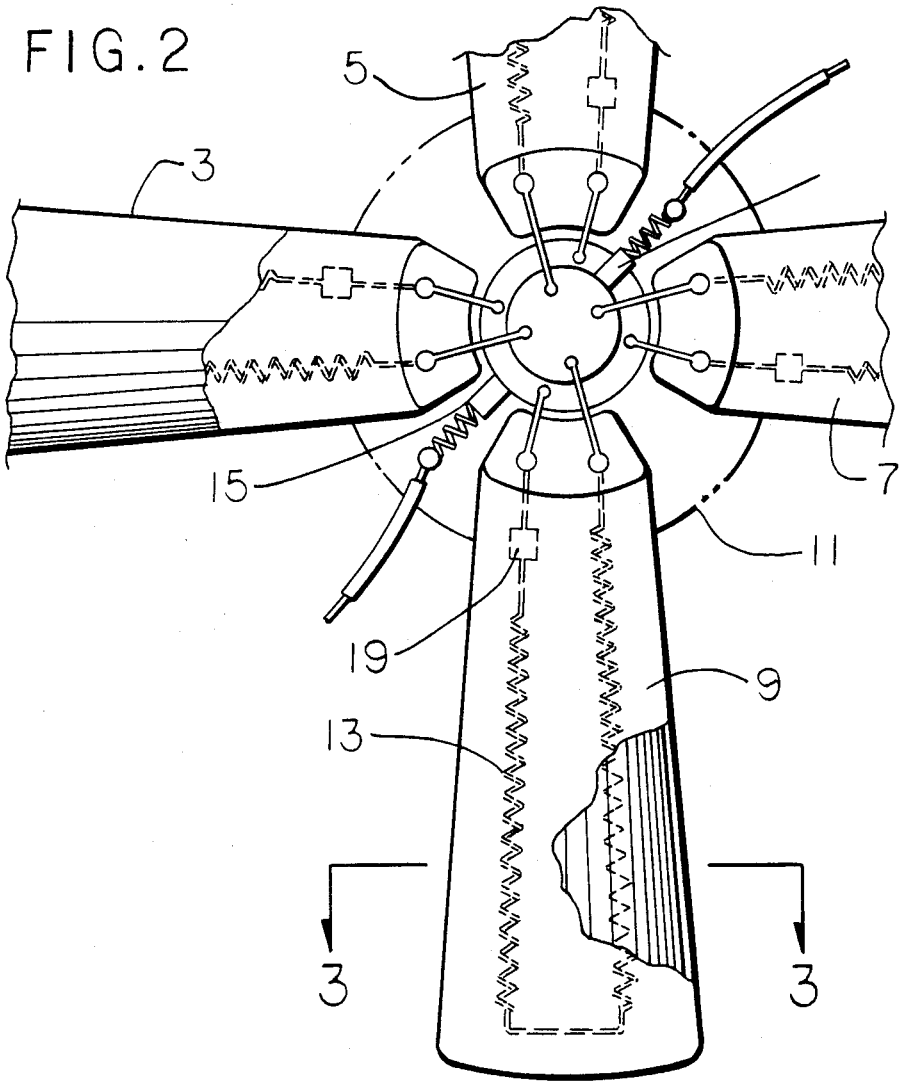
FIG. 2 of the drawings illustrates the fan of FIG. 1 in cross section through the blade sections so as to illustrate heating elements therein.

The novelty of the ceiling fan in accordance with this invention is illustrated in FIG. 2 wherein a cross section through the blade structures 3, 5, 7, and 9 and housing 11 illustrates the presence of heating means 13 within the individual blades. Heating means 13 maybe any well-known resistance heating means such as Nicrome alloys or graphite. Heating means 13 derives electrical power from double-sliperings 15 and 17 housed within in housing 11. Housing 11 together with the electrical motor contained therein comprise means for rotating the plurality blades 3, 5, 7 and 9. Additionally, a thermostatically controlled breaker 19 is illustrated in association with each heating means within each blade structure. This is for the purpose of preventing any overheating of the blade during use.

Figure 3:
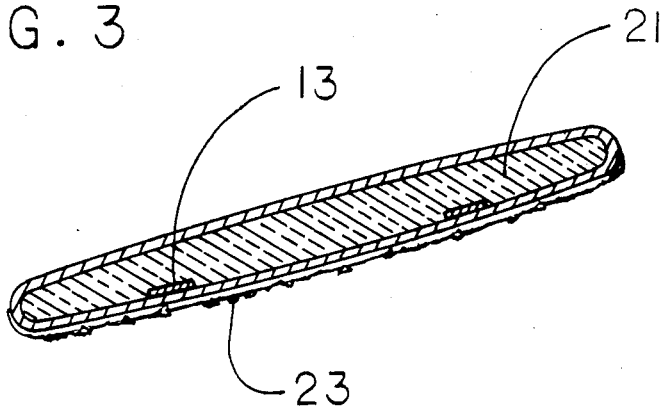
FIG. 3 of the drawings is a cross section across a vertical plane of one of the blades illustrated in FIG. 2 through the line to 3—3.

FIG. 3 of the drawings is a cross-section along line 3—3 of FIG. 2 and illustrates sections of heating means 13 on either side thereof. Above and surrounding heating means 13 is an insulating material, 21 such as asbestos or rock wool to prevent loss of heat through the upper surface of the blade structure. As a preferred aspect of this invention lower blade surface 13 may be coated with fine particles; such as silicon dioxide in the form of sand or ground quartz to enhance the emissivity and thus emission of heat from the blade surface 23. Such roughened surface not only enhances the emmission of heat therefrom, but provides for 180 degrees emission from blade surface 23. A preferred formula for coating surface 23 comprises a mixture in parts by weight of 80 parts latex paint, 10 parts fine sand, and 10 parts ground quartz.

Figure 4:
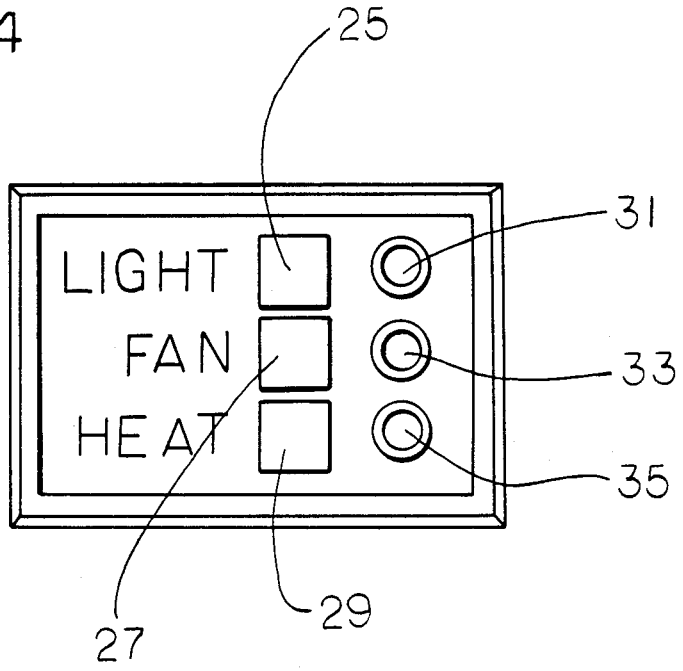
FIG. 4 of the drawings illustrates a typical control panel for the ceiling fan in accordance with this invention.

FIG. 4 of the drawings illustrates a typical controll with rheostats associated with each function. Independent push on and push off switches 25, 27 and 29 and associated rheostats 31, 33 and 35 are utilized independently to controll light only, a fan only or a heat only. It is understood that any combination of the features might be utilized. Thus, the heated ceiling fan in accordance with this invention maybe utilized to heat the surrounding environment in the radiant mode when the fan is stationary and by both radiant and convective modes when the fan blades are activated.

It is thus apparent that the ceiling fan of this invention provides a significant improvement upon conventional overhead ceiling fans; and provides a capability of producing not only air-movement, but heat as well. The ceiling fan in accordance with this invention may provide heat in both radiant and convective modes. As many variations will be apparent to those in the art from the reading of the above description, such variations are included within the spirit and scope of this invention as defined by the following appended claims.

What is claimed is:

1. A ceiling fan, comprising:

a plurality of blades, each of said blades defining a generally hollow interior portion, each of said blades having a lower surface, said lower surface having a rough coating of particles to enhance the emission of heat therefrom;

means for rotating said plurality of blades about a vertical axis;

means for attaching said means for rotating to a ceiling;

resistance heating elements extending lengthwise through said hollow interior portion of said blades extending from near said axis to the opposite end of each of said blades and returning lengthwise opposite through said blade toward said axis, said hollow interior portion above said heating element being generally filled with an insulating material and the hollow interior portion below said heating elements being filled with a heat conducting material; and control means for independently controlling said heating means and said means for rotating.

2. The apparatus according to claim 1 further including thermostatically controlled electrical breakers associated with each of said heating means in each of said blades.

* * * * *